US009902580B2

(12) United States Patent
Okumura et al.

(10) Patent No.: US 9,902,580 B2
(45) Date of Patent: Feb. 27, 2018

(54) SHEET FEEDING DEVICE

(71) Applicant: PFU LIMITED, Kahoku-shi, Ishikawa (JP)

(72) Inventors: Hideyuki Okumura, Ishikawa (JP); Masanobu Hongo, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 0 days.

(21) Appl. No.: 15/417,757

(22) Filed: Jan. 27, 2017

(65) Prior Publication Data

US 2017/0137242 A1 May 18, 2017

Related U.S. Application Data

(63) Continuation of application No. PCT/JP2014/076693, filed on Oct. 6, 2014.

(51) Int. Cl.
*B65H 3/06* (2006.01)
*B65H 1/06* (2006.01)
(Continued)

(52) U.S. Cl.
CPC ..... *B65H 3/063* (2013.01); *B65H 1/06* (2013.01); *B65H 3/52* (2013.01); *B65H 1/025* (2013.01);
(Continued)

(58) Field of Classification Search
CPC ... B65H 1/025; B65H 1/06; B65H 2405/1111; B65H 2405/11162; B65H 2405/111646;
(Continued)

(56) References Cited

U.S. PATENT DOCUMENTS 5,552,859 A * 9/1996 Nakagawa ..... B65H 3/62 271/110
2006/0012109 A1 1/2006 Chiang
(Continued)

FOREIGN PATENT DOCUMENTS

CN 1050001 A 3/1991
JP S57-160839 A 10/1982
(Continued)

OTHER PUBLICATIONS

Search Report issued in corresponding International Patent Application No. PCT/JP2014/076693, dated Nov. 18, 2014.
Office Action issued in corresponding Chinese Patent Application No. 201480081947.8, dated Aug. 23, 2017.

*Primary Examiner* — Howard J Sanders
(74) *Attorney, Agent, or Firm* — McDermott Will & Emery LLP

(57) ABSTRACT

A sheet feeding device includes a document mounting board, in which a downstream end of the document mounting board in the feeding direction of the documents in the feed mechanism is connected to a scanner body so as to be rotatable about a first turning shaft parallel to a rotation shaft of a pickup roller, the first turning shaft is located downstream from the feed mechanism in the feeding direction of the documents in the feed mechanism, a mounting surface of the document mounting board on which the documents are mounted is located above the pickup roller when the documents are mounted on the document mounting board, and the document mounting board turns about the first turning shaft such that the mounting surface moves downward and the mounting surface moves downward from a contact portion of the pickup roller with the document when the documents mounted on the document mounting board are fed.

4 Claims, 8 Drawing Sheets

(51) Int. Cl.
*B65H 3/52* (2006.01)
*B65H 1/02* (2006.01)

(52) U.S. Cl.
CPC ..... *B65H 2405/1111* (2013.01); *B65H 2405/1134* (2013.01); *B65H 2405/11162* (2013.01); *B65H 2405/111646* (2013.01); *B65H 2405/2111* (2013.01)

(58) Field of Classification Search
CPC .. B65H 2405/11171; B65H 2405/1124; B65H 2405/1134; B65H 2405/2111; B65H 3/063
See application file for complete search history.

(56) References Cited

U.S. PATENT DOCUMENTS

| | | | | |
|---|---|---|---|---|
| 2006/0097441 | A1 | 5/2006 | Shikan et al. | |
| 2013/0020752 | A1* | 1/2013 | Kapturowski ..... | B65H 3/0875 271/10.09 |

FOREIGN PATENT DOCUMENTS

| | | | |
|---|---|---|---|
| JP | H03-061218 | A | 3/1991 |
| JP | 07-101581 | A | 4/1995 |
| JP | 10-035897 | A | 2/1998 |
| JP | 2001-328730 | A | 11/2001 |
| JP | S677356 | B2 | 7/2005 |
| JP | 2007-137526 | A | 6/2007 |
| WO | 2004/080863 | A1 | 9/2004 |

* cited by examiner

SHEET FEEDING DEVICE

CROSS-REFERENCE TO RELATED APPLICATION

This application is a continuation of International Application No. PCT/JP2014/076693, filed on Oct. 6, 2014, the entire contents of which are incorporated herein by reference.

FIELD

The present disclosure relates to a sheet feeding device.

BACKGROUND

More image scanners that read an image of a document and electrically process the read image, or more printers that print an image, have employed a sheet feeding device that feeds a sheet such as a document from which an image is read or a paper sheet on which an image is printed to an image reading unit or a printing unit. The sheet feeding device feeds a document downstream by rotating a pickup roller, which has a relatively large frictional coefficient, while coming in contact with the document. Since the pickup roller feeds a document downstream using a frictional force with the document, sheet feeding devices in which a contact state of a document with the pickup roller is adjusted to appropriately feed the document, are known (for example, Japanese Laid-open Patent Publication No. 10-35897 and Japanese Laid-open Patent Publication No. 2007-137526.)

However, when a document properly comes in contact with the pickup roller at the time of feeding but documents are not properly set on a document mounting board, a problem, in which a document cannot be fed downstream due to non-contact of the document with the pickup roller, may occur at the time of feeding a document using the pickup roller. For example, as described in JP 10-35897 A, when a guide is disposed upstream from the pickup roller and a document is separated apart upward from the pickup roller by the guide turning upward on standby, documents may stop in a part of the guide turning upward at the time of setting documents and the documents may not reach the position of the pickup roller. In this case, even when the guide is lowered at the time of feeding a document, no documents is present at the position of the pickup roller and thus no document can be forwarded downstream. Accordingly, there is room for improvement in a structure for feeding a document without causing non-feeding.

SUMMARY

According to an aspect of an embodiment, a sheet feeding device includes: a document mounting board configured to have documents mounted thereon; a feed mechanism configured to include a pickup roller rotating to forward the documents and to feed the documents mounted on the document mounting board to a downstream side in a feeding direction of the documents; and a base portion configured to support the feed mechanism, wherein a downstream end of the document mounting board in the feeding direction of the document in the feed mechanism, is connected to the base portion, so as to be rotatable about a first turning shaft that is parallel to a rotation shaft of the pickup roller, the first turning shaft is located downstream from the feed mechanism in the feeding direction of the document in the feed mechanism, a mounting surface of the document mounting board on which the documents are mounted, is located above the pickup roller, when the documents are mounted on the document mounting board, and the document mounting board turns about the first turning shaft such that the mounting surface moves downward and the mounting surface moves downward from a contact portion of the pickup roller with the document, when the documents mounted on the document mounting board are fed.

The object and advantages of the disclosure will be realized and attained by means of the elements and combinations particularly pointed out in the claims.

It is to be understood that both the foregoing general description and the following detailed description are exemplary and explanatory and are not restrictive of the disclosure, as claimed.

DESCRIPTION OF EMBODIMENTS

Hereinafter, a sheet feeding device according to an embodiment of the present disclosure will be described in detail with reference to the accompanying drawings. The present disclosure is not limited to the embodiment. Elements in the following embodiment include elements that can be easily replaced by those skilled in the art or elements that are substantially equal to each other.

Embodiment

Figure 1:
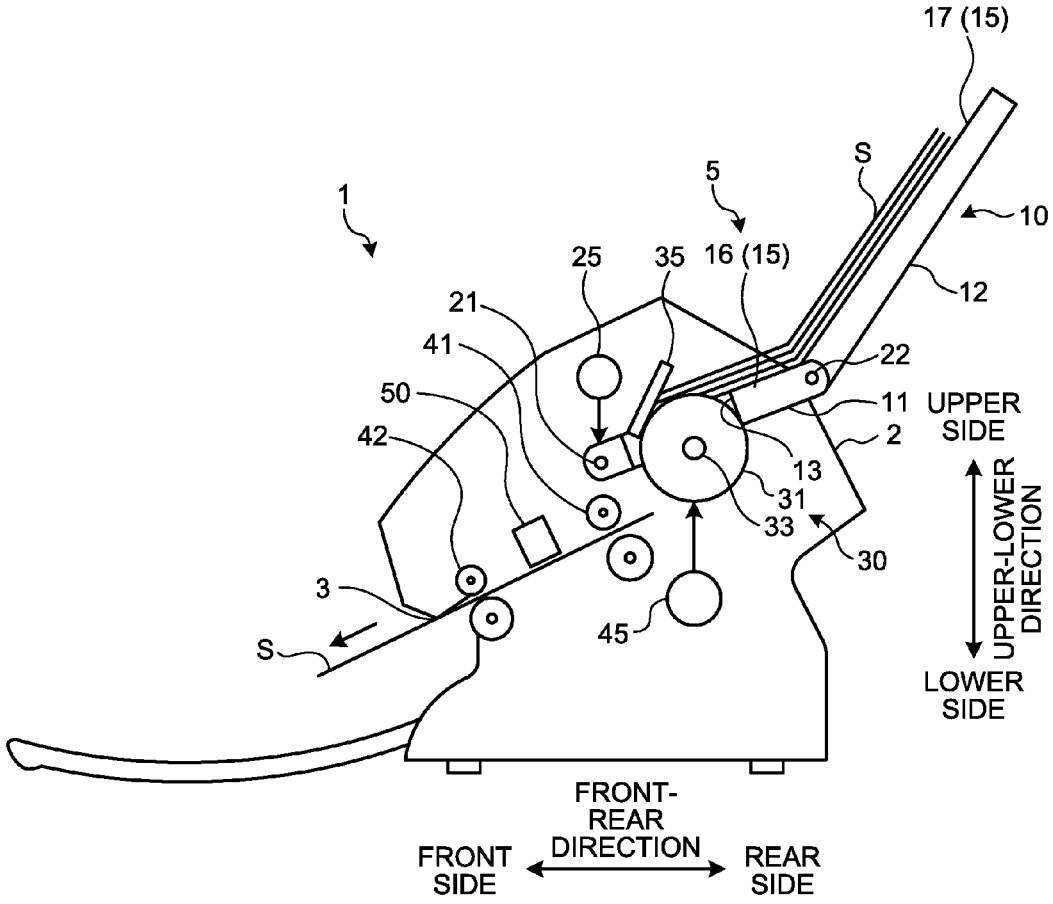
FIG. 1 is a diagram schematically illustrating a scanner including a sheet feeding device according to an embodiment.

FIG. 1 is a schematic diagram illustrating a scanner including a sheet feeding device according to an embodiment. A sheet feeding device 5 of a scanner 1 illustrated in FIG. 1 is configured as a device that separates documents S which are a plurality of feeding mediums stacked one by one and conveys the separated document S to an image reading unit 50 by which images of the document S are read. The sheet feeding device 5 includes a document mounting board 10 on which the documents S to be forwarded to the image reading unit 50 are mounted. The document mounting board 10 is attached to a scanner body 2 of the scanner 1 so as to be inclined from up to down from an upstream side to a downstream side in a conveyance direction of the document S when the scanner 1 is used. A top surface thereof serves as a mounting surface 15 on which the documents S are mounted.

The sheet feeding device 5 includes a feed mechanism 30 that feeds the document S mounted on the document mounting board 10 to the downstream side in the feeding direction of the document S, and the scanner body 2 also serves as a base portion that supports the feed mechanism 30. That is, constituent members of the feed mechanism 30 are directly or indirectly attached to the scanner body 2 as the base portion. The feed mechanism 30 attached to the scanner body 2 in this way includes a pickup roller 31 that rotates to forward a document S and a separation member 35 that can separate the document S to be fed by the pickup roller 31 and feed only one document to the image reading unit 50.

Among these, the pickup roller 31 is formed in a substantially columnar shape, an outer circumferential surface thereof is formed of a member such as rubber having a relatively high frictional coefficient, and a rotation shaft 33 thereof is perpendicular to a conveyance direction of the document S and is rotatable in a direction substantially parallel to a horizontal direction. An upper end of the outer circumferential surface of the pickup roller 31 is rotatable about the rotation shaft 33 toward the downstream side in the feeding direction of a document S by a driving force transmitted from a feed driving motor 45.

The separation member 35 is disposed in the vicinity of the pickup roller 31 and at a position downstream from the vicinity of the upper end of the pickup roller 31. The separation member 35 can forward only one document to the image reading unit 50 by regulating movement of the documents S other than the document S in contact with the pickup roller 31 among the documents S moving downstream in the conveyance direction by the rotating pickup roller 31.

A downstream end of the document mounting board 10 in the feeding direction of the document S in the feed mechanism 30, is connected to the scanner body 2 such that the document mounting board 10 attached to the scanner body 2 is rotatable about a first turning shaft 21. The first turning shaft 21 is a turning shaft which is located downstream from the feed mechanism 30 in the feeding direction of the document S in the feed mechanism 30, and the first turning shaft 21 is parallel to the rotation shaft 33 of the pickup roller 31, and connects the document mounting board 10 to the scanner body 2.

The document mounting board 10 connected to the scanner body 2 in this way, includes a first member 11 and a second member 12, and the first member 11 is connected to the scanner body 2 so as to be rotatable about the first turning shaft 21. The second member 12 is connected to an end of the first member 11 opposite to the end connected to the scanner body 2, and the second member 12 is connected to the first member 11 so as to be rotatable about a second turning shaft 22 which is disposed parallel to the first turning shaft 21.

In both of the first member 11 and the second member 12, the top surfaces when the scanner 1 is normally used, serve as the mounting surface 15 on which the documents S are mounted. That is, a first mounting surface 16, which is the mounting surface of the first member 11 on which the documents S are mounted, and a second mounting surface 17, which is the mounting surface of the second member 12 on which the documents S are mounted, are both formed on the top surfaces of the first member 11 and the second member 12 when the scanner 1 is normally used. Among these, the first mounting surface 16 has a friction reducing processed portion for reducing frictional resistance against the document S moving in the feeding direction of the feed mechanism 30. For example, the first mounting surface 16 is subjected to surface treatment using a material having a low frictional coefficient such as a fluorine-based material and thus the frictional coefficient of the first mounting surface 16 is lowered.

A pickup roller hole 13, which is a hole through which the pickup roller 31 passes, is formed in the first member 11. That is, the pickup roller 31 can forward the document S by rotating about the rotation shaft 33 and bringing the upper end of the outer circumferential surface thereof into contact with the document S when feeding the document S in the feed mechanism 30. On the other hand, the first turning shaft 21, which is a turning shaft for turning of the first member 11 and which is located downstream from the feed mechanism 30 in the feeding direction of the document S in the feed mechanism 30, is located downstream from the pickup roller 31 in the feeding direction of the document S in the feed mechanism 30.

Accordingly, the pickup roller hole 13, which is a hole through which an upper part of the pickup roller 31 of which the rotation shaft 33 is located below the first member 11 passes from the bottom surface of the first member 11 to the top surface thereof and which locates the upper part of the pickup roller 31 above the first mounting surface 16, is formed in the first member 11. When the scanner 1 is normally used, the upper part of the pickup roller 31 passes through the pickup roller hole 13 such that the upper part is located above the first mounting surface 16.

In this way, by transmitting a driving force generated by a mounting board driving motor 25 to the document mounting board 10 including the first member 11 and the second member 12, the document mounting board 10 can turn about the first turning shaft 21 or the second turning shaft 22. That is, the document mounting board 10 includes a transmission mechanism (not illustrated) transmitting a driving force generated by the mounting board driving motor 25 and thus the first member 11 of the document mounting board 10 can turn about the first turning shaft 21 and the second member 12 can turn about the second turning shaft 22.

In the scanner body 2, a conveyance roller 41 is disposed downstream from the feed mechanism 30 in the feeding direction of the documents S in the feed mechanism 30. On the downstream side of the conveyance roller 41 in the conveyance direction of the documents S in the conveyance roller 41, a discharge roller 42 is disposed in the vicinity of a discharge port 3 of the documents S. The image reading unit 50 is disposed between the conveyance roller 41 and the discharge roller 42 in the conveyance direction of the documents S, that is, the image reading unit 50 is disposed downstream from the feed mechanism 30 in the feeding direction of the documents S in the feed mechanism 30. Accordingly, the image reading unit 50 can read an image of the document S fed by the feed mechanism 30.

Figure 2:
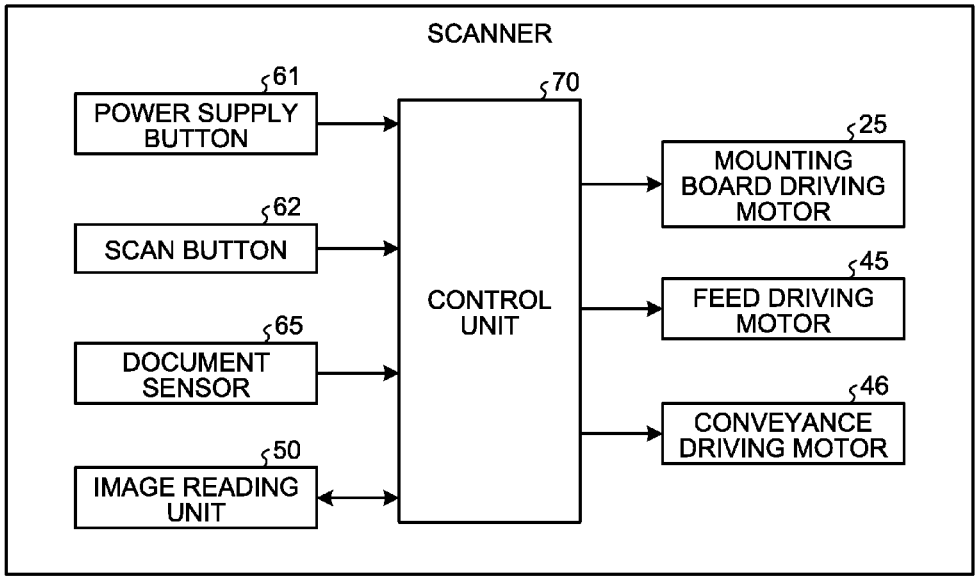
FIG. 2 is a functional block diagram of the scanner including the sheet feeding device according to the embodiment.

FIG. 2 is a functional block diagram of a scanner including the sheet feeding device according to the embodiment. The hardware configuration of the control unit 70 includes a central processing unit (CPU), a graphic processing unit (GPU), a digital signal processor (DSP), a large scale integrated circuit (LSI), an application specific integrated circuit (ASIC), and/or a field-programming gate array (FPGA), functioning as the material controller that mainly performs operation process, or includes a control circuit. The control unit 70 includes a random access memory (RAM) and a read only memory (ROM) that sore programs or information, a fixed disk drive such as a hard disk drive, a solid state drive (SSD), and/or an optical disk, storing various kinds of information, and the like. In addition, The control unit 70 includes an input/output interface, and the hardware configuration of the control unit 70 is the same as a conventional personal computer or a scanner device and thus detailed description thereof will not be made. The mounting board driving motor 25 and the feed driving motor 45 are electrically connected to the control unit 70 and can be controlled by the control unit 70. A conveyance driving motor 46 that generates a driving force for causing the conveyance roller 41 and the discharge roller 42 to rotate, is also electrically connected to the control unit 70 and can be controlled by the control unit 70. The image reading unit 50 is also electrically connected to the control unit 70 and can be controlled by the control unit 70, and image data read by the image reading unit 50 can be transmitted to the control unit 70.

The scanner 1 includes a power supply button 61 that switches ON and OFF of a power supply, a scan button 62 that causes the scanner 1 to start scanning, and a document sensor 65 that detects presence of a document S mounted on the document mounting board 10, and these are also electrically connected to the control unit 70. Among these, the power supply button 61 and the scan button 62 are disposed on the surface of the scanner 1 and can be operated by a user of the scanner 1. The document sensor 65 is disposed in the vicinity of the document mounting board 10 in the scanner body 2, and the document sensor 65 can detect presence of a document S mounted on the document mounting board 10 using infrared rays or the like.

Figure 3:
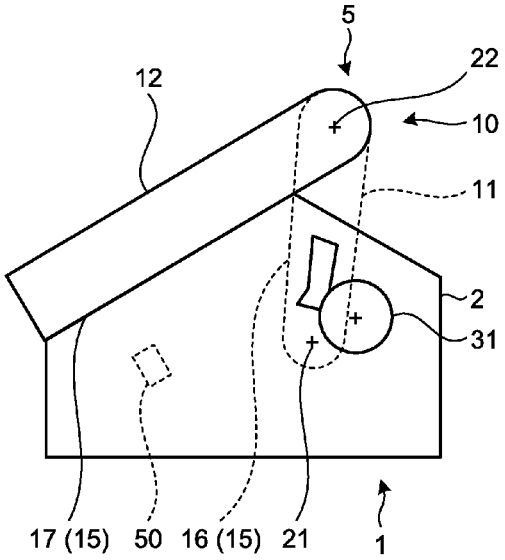
FIG. 3 is a diagram illustrating a state in which the scanner illustrated in FIG. 1 is not used.

The sheet feeding device 5 according to this embodiment has the above-mentioned configuration and operations thereof will be described below. FIG. 3 is a diagram illustrating a state in which the scanner illustrated in FIG. 1 is not used. When the scanner 1 according to this embodiment is not used, the document mounting board 10 can be set to be parallel to the top surface of the scanner body 2 from the upper side of the top surface of the scanner body 2 and thus the document mounting board 10 can become a storage state. Specifically, when an image of a document S is not read by the image reading unit 50 and the document mounting board 10 is changed to the storage state, the first member 11 of the document mounting board 10 turns about the first turning shaft 21 to the image reading unit 50. Accordingly, the first member 11 rises upward, and an end thereof opposite to an end close to the first turning shaft 21, is located on the top surface of the scanner body 2.

The second member 12 turns about the second turning shaft 22 to the image reading unit 50. Accordingly, the second member 12 is located above the image reading unit 50 in the scanner body 2 and is disposed parallel to the top surface of the scanner body 2. When the scanner 1 is not used, the second member 12 is changed to the storage state in which the second member 12 is parallel to the top surface of the scanner body 2 and thus the document mounting board 10 is stored.

Figure 4:
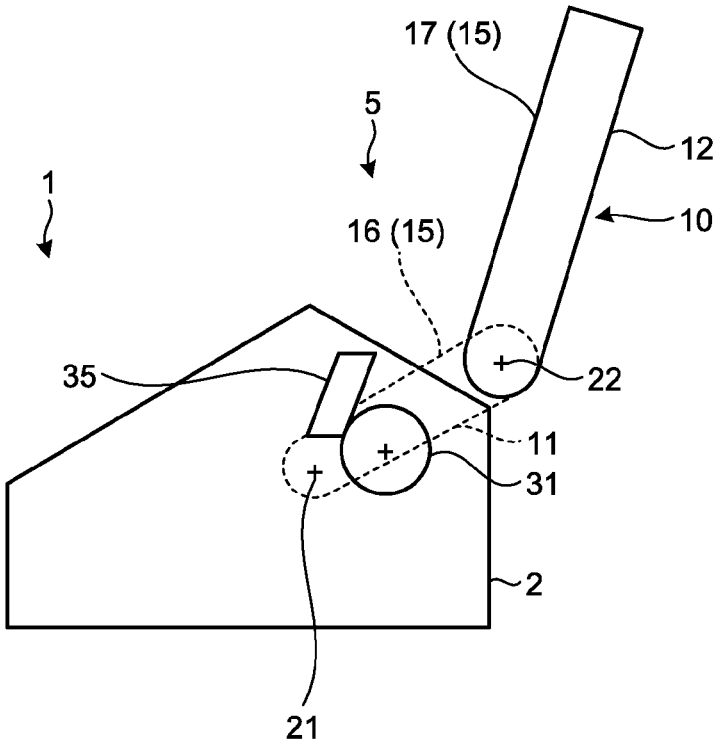
FIG. 4 is a diagram illustrating a state in which documents are mounted on a document mounting board illustrated in FIG. 1.

FIG. 4 is a diagram illustrating a state in which documents are mounted on the document mounting board illustrated in FIG. 1. When documents S are mounted on the document mounting board 10 to read images of the documents S using the scanner 1, the first member 11 turns about the first turning shaft 21 in a direction in which the first member 11 is laid down, and the second member 12 turns about the second turning shaft 22 in a direction in which the second member 12 is separated apart from the scanner body 2. Accordingly, the mounting surface 15 of the document mounting board 10 is inclined from up to down from upstream to the downstream in the feeding direction of the document S. In this case, an angle formed by the first mounting surface 16 of the first member 11 and the second mounting surface 17 of the second member 12, is set to be less than 180°.

In this way, when the document mounting board 10 is changed to a document mounting state in which documents S are mounted on the document mounting board 10, the document mounting board 10 turns about the first turning shaft 21 to a position at which the top end of the pickup roller 31 is not located above the first mounting surface 16 of the first member 11 by causing the pickup roller 31 to pass through the pickup roller hole 13. Accordingly, when mounting documents S on the document mounting board 10, the document mounting board 10 is inclined from up to down from an upstream end in the feeding direction of a document S to the end on the first turning shaft 21 side at an angle at which the mounting surface 15 for the documents S is located above the pickup roller 31. Accordingly, when mounting documents S on the document mounting board 10, the document mounting board 10 is changed to a state, in which the first mounting surface 16 of the first member 11 is located above the pickup roller 31.

Figure 5:
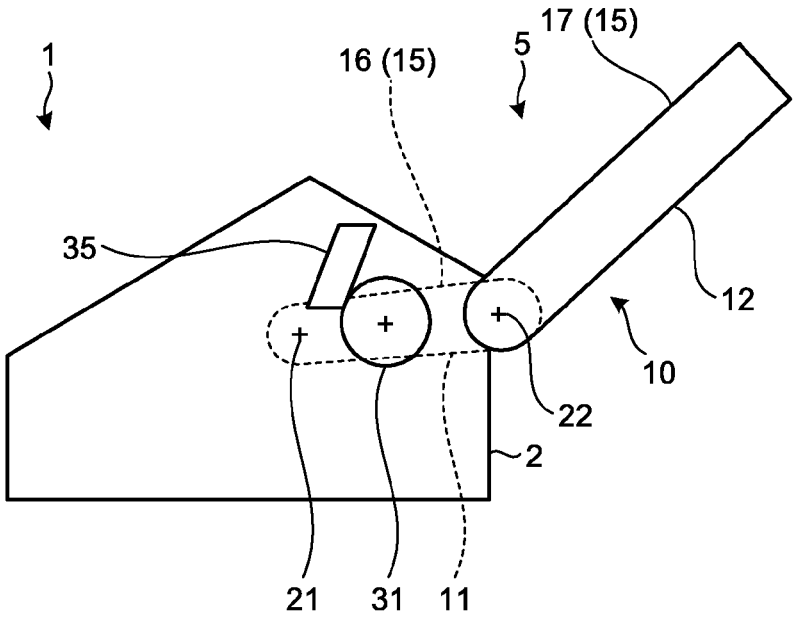
FIG. 5 is a diagram illustrating a state in which documents mounted on the document mounting board illustrated in FIG. 1 are fed.

FIG. 5 is a diagram illustrating a state in which a document mounted on the document mounting board illustrated in FIG. 1 is fed. When a document S mounted on the document mounting board 10 is fed by the feed mechanism 30 to read an image of the document S using the scanner 1, the document mounting board 10 is changed to an document feeding state by turning about the first turning shaft 21 in a direction in which the mounting surface 15 moves downward. Accordingly, the pickup roller 31 passes through the pickup roller hole 13 of the first member 11 from the lower side of the first member 11 and the pickup roller 31 protrudes from the pickup roller hole 13 such that the top end thereof is located above the first mounting surface 16 of the first member 11.

In other words, for change to the document feeding state, the document mounting board 10 turns about the first turning shaft 21 in a direction in which the mounting surface 15 moves downward such that the first mounting surface 16 is located below the top end of the pickup roller 31 passing through the pickup roller hole 13 from the lower side of the first member 11. In this case, the document mounting board 10 is inclined from up to down from the upstream end in the feeding direction of a document S to the end on the first turning shaft 21 side, and the inclination angle thereof is smaller than the inclination angle in the state in which documents S are mounted on the document mounting board 10.

Figure 6:
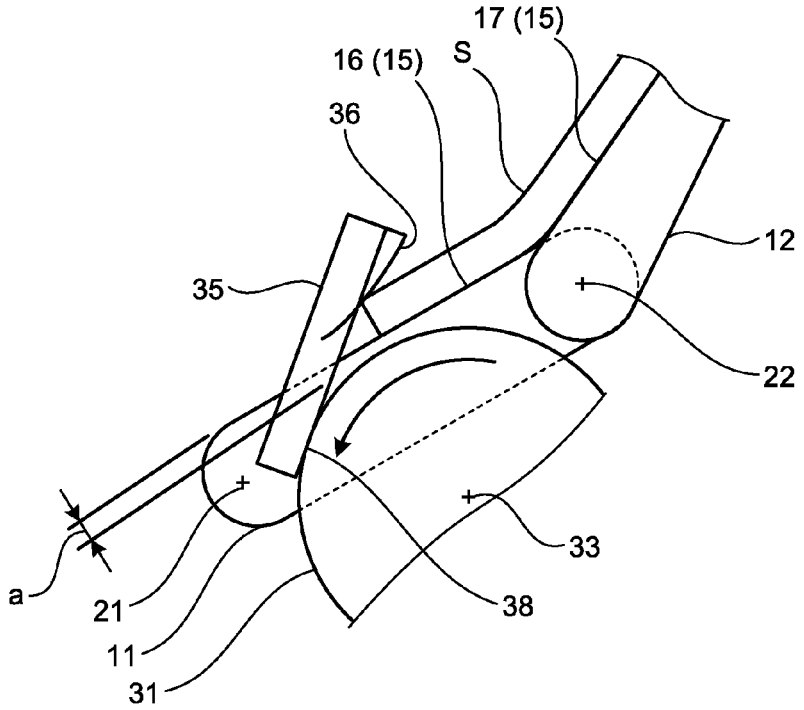
FIG. 6 is a detailed diagram illustrating a periphery of a pickup roller in FIG. 4.

FIG. 6 is a detailed diagram of a periphery of the pickup roller in FIG. 4. When the document mounting board 10 is changed to the document mounting state (see FIG. 4) and documents S are mounted on the mounting surface 15, the document mounting board 10 in the document mounting state is inclined from up to down from upstream to downstream in the feeding direction of a document S and thus the documents S move downstream in the feeding direction with their own weight. That is, the documents S mounted on the mounting surface 15 move from the second mounting surface 17 side to the first mounting surface 16 side.

In this case, since the document mounting board 10 in the document mounting state has a larger inclination angle than that of the document mounting board 10 in the document feeding state, the documents S can easily move to the first mounting surface 16 side. Since the first mounting surface 16 has a friction reducing processed portion and a frictional force between the document S coming in contact with the first mounting surface 16 and the first mounting surface 16 decreases, the document S coming in contact with the first mounting surface 16 can move more easily downstream in the feeding direction of a document S.

Here, the pickup roller 31 is disposed downstream from the document mounting board 10 in the feeding direction of a document S, but when the document mounting board 10 is in the document mounting state, the first mounting surface 16 of the first member 11 is located above the pickup roller 31. That is, the pickup roller 31 does not protrude upward from the pickup roller hole 13. Accordingly, the documents S, which is mounted on the mounting surface 15 of the document mounting board 10 and which is moved downstream in the feeding direction with their own weight, move to the position of the separation member 35 disposed downstream from the pickup roller 31 without coming in contact with the pickup roller 31.

A pickup spring 36 serving as a buffer member when documents S come in contact with the separation member 35, is disposed on an upstream surface of the separation member 35 in the feeding direction of a document S, and the documents S moving to the position of the separation member 35 with their own weight, are buffered by the pickup spring 36 and ends thereof come in contact with the separation member 35. Since the documents S move to the position of the separation member 35 and come in contact with the separation member 35 in this way, the documents S mounted on the document mounting board 10 can be fed by the pickup roller 31 when the feed mechanism 30 feeds the documents S.

It is preferable that the first mounting surface 16 of the first member 11 located above the pickup roller 31 be separated from the pickup roller 31 by a predetermined distance a or more. That is, when the distance a between the first mounting surface 16 and the pickup roller 31 is too small, a case in which a part of a document S enters the pickup roller hole 13 and comes in contact with the pickup roller 31 having a high friction coefficient and movement of the document S is stopped, is considered. In this way, it is preferable that the distance a between the first mounting surface 16 and the pickup roller 31 be about 2 mm, such that the document S entering the pickup roller hole 13 does not come in contact with the pickup roller 31.

Figure 7:
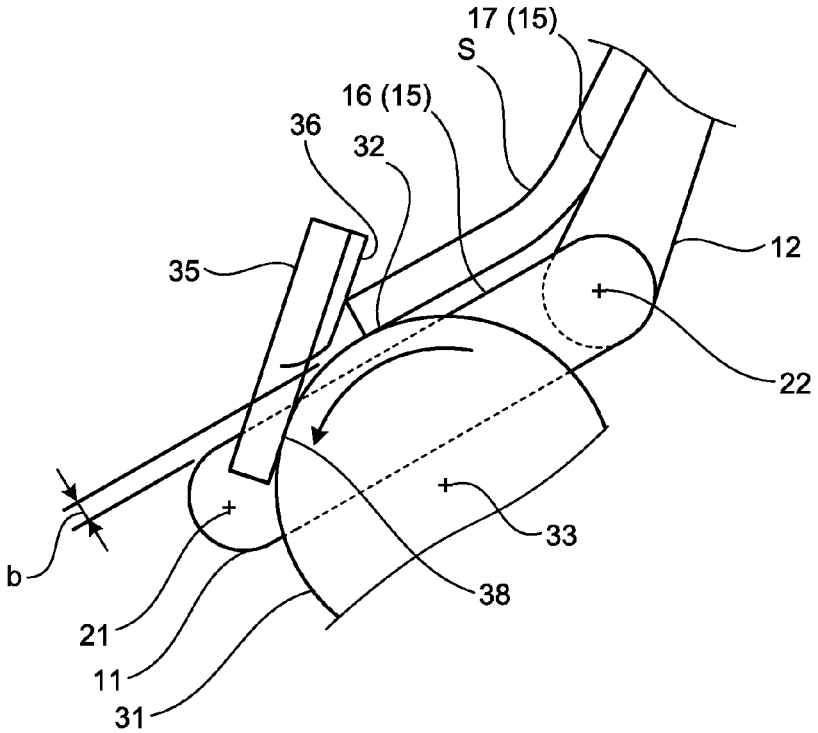
FIG. 7 is a detailed diagram illustrating a periphery of the pickup roller in FIG. 5.

FIG. 7 is a detailed diagram of the periphery of the pickup roller in FIG. 5. When the feed mechanism 30 feeds documents S mounted on the document mounting board 10, the document mounting board 10 turns about the first turning shaft 21 in a direction in which the mounting surface 15 moves downward, whereby the document mounting board 10 is changed to the document feeding state (see FIG. 5). Accordingly, the mounting surface 15 of the document mounting board 10 moves downward from a contact portion 32 of the pickup roller 31 with the document S. That is, when the documents S mounted on the document mounting board 10 are fed, the document mounting board 10 turns about the first turning shaft 21 such that the first mounting surface 16 moves downward from the contact portion 32 of the pickup roller 31 with the document S. Accordingly, the document S located at the lowermost among the documents S mounted on the document mounting board 10 comes in contact with the pickup roller 31.

Since the outer circumferential surface of the pickup roller 31 has a high frictional coefficient, the lowermost document S among the documents S mounted on the document mounting board 10, is fed in the rotating direction of the pickup roller 31 due to a frictional force with the pickup roller 31 by causing the pickup roller 31 to rotate in a state in which the document S comes in contact therewith. That is, since the pickup roller 31 rotates in a direction in which the top end of the outer circumferential surface moves downstream in the feeding direction of a document S, the document S coming in contact with the pickup roller 31 at the contact portion 32 among the documents S mounted on the document mounting board 10, moves downstream in the feeding direction with the rotation of the pickup roller 31.

At this time, the documents S other than the document S coming in contact with the pickup roller 31, are drawn by the document S coming in contact with the pickup roller 31 and try to move downstream in the feeding direction, but movement of the documents S is regulated by the separation member 35 disposed downstream from the pickup roller 31. Accordingly, when the pickup roller 31 rotates in a state in which the documents S mounted on the document mounting board 10 come in contact with the pickup roller 31, only the lowermost document S coming in contact with the pickup roller 31 is fed downstream from the pickup roller 31. That is, when a plurality of documents S are mounted on the document mounting board 10, the feed mechanism 30 separates the documents S by using the separation member 35 and feeds only one document to the image reading unit 50.

It is preferable that a distance b between the first mounting surface 16 and the contact portion 32 of the pickup roller 31 with the document S when the first mounting surface 16 moves downward from the contact portion 32 of the pickup roller 31 with the document S be equal to or greater than 3 mm. That is, it is preferable that the protruding distance b of the pickup roller 31 from the first mounting surface 16 be equal to or greater than 3 mm. When the protruding distance b of the pickup roller 31 from the first mounting surface 16 is too small at the time of feeding a document S, a pushed-up distance of the document S by the pickup roller 31 is small, and thus the weight of the documents S is not applied to the pickup roller 31. In this case, a frictional force between the pickup roller 31 and the document S decreases and thus the document S cannot be appropriately conveyed. Accordingly, it is preferable that the protruding distance b of the pickup roller 31 from the first mounting surface 16 be equal to or greater than 3 mm so as to secure a frictional force between the pickup roller 31 and the document S.

Figure 8:
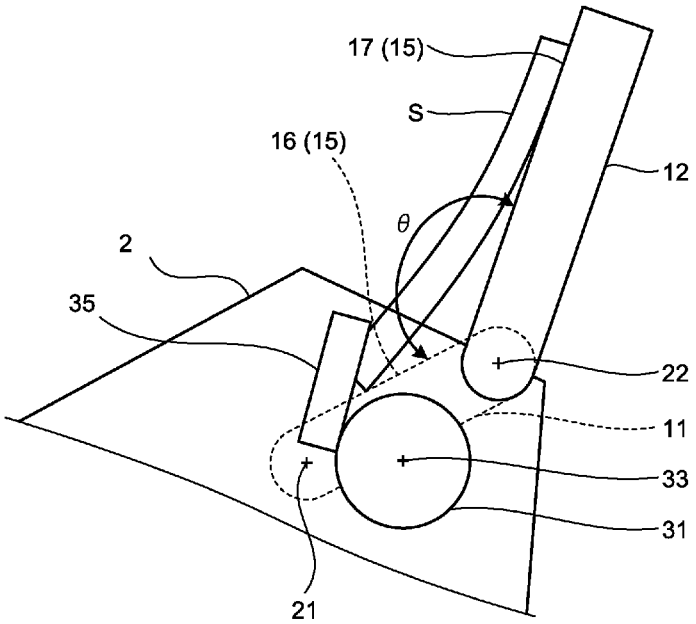
FIG. 8 is a diagram illustrating an angle between a first member and a second member and illustrating a document mounting state.
Figure 9:
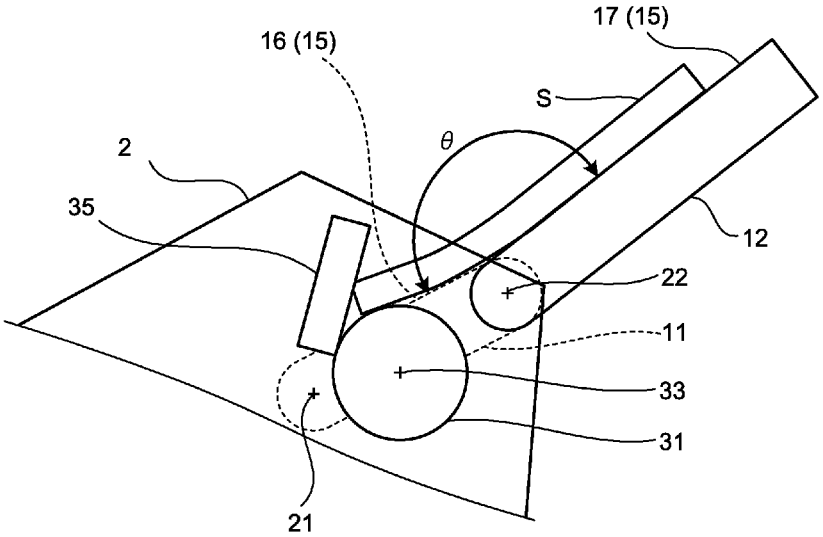
FIG. 9 is a diagram illustrating the angle between the first member and the second member and illustrating a document feeding state.

FIG. 8 is a diagram illustrating an angle between the first member and the second member and is illustrating the document mounting state. FIG. 9 is a diagram illustrating the angle between the first member and the second member and is illustrating the document feeding state. The document mounting board 10 can be switched between the document mounting state and the document feeding state by turning about the first turning shaft 21, but the relative angle between the first member 11 and the second member 12 in the document mounting board 10 is also changed in the document mounting state and the document feeding state. Specifically, in the document mounting board 10, the angle θ formed by the first mounting surface 16 and the second mounting surface 17, when the documents S are mounted on the document mounting board 10, is set to be smaller than that when the documents S are fed.

For example, when the document mounting board 10 is switched from the document feeding state (FIG. 9) to the document mounting state (FIG. 8), the angle θ formed by the first mounting surface 16 and the second mounting surface 17, decreases by causing the second member 12 to turn about the second turning shaft 22 relative to the first member 11. Accordingly, when the documents S are mounted on the document mounting board 10, a contact area between the document S and the second member 12 decreases, and thus the frictional force between the document S and the second member 12 decreases. By decreasing the angle θ formed by the first mounting surface 16 and the second mounting surface 17, the second member 12 is close to an upright state and thus a ratio of the weight of the documents S applied to the first member 11 increases. Since the frictional resistance of the first mounting surface 16 of the first member 11 decreases by the friction reducing process, the documents S mounted on the document mounting board 10, can easily move downstream in the feeding direction and can easily reach the separation member 35 of the feed mechanism 30.

On the other hand, when the document mounting board 10 is switched from the document mounting state (FIG. 8) to the document feeding state (FIG. 9), the angle θ formed by the first mounting surface 16 and the second mounting surface 17, increases by causing the second member 12 to turn about the second turning shaft 22 relative to the first member 11. Accordingly, since the contact area between the mounting surface 15 of the document mounting board 10 and the document S increases, the document S can be stably held while the document S is fed by the feed mechanism 30.

In the sheet feeding device 5 according to this embodiment, the document S can be appropriately fed by switching the document mounting board 10 between the document mounting state and the document feeding state, which can be realized by setting the positional relationship of the first turning shaft 21, the second turning shaft 22, and a separation nip 38 (see FIGS. 6 and 7) to an appropriate positional relationship. That is, in the sheet feeding device 5, since the first turning shaft 21, the second turning shaft 22, and the separation nip 38 are arranged from upstream to downstream in the feeding direction of a document S in the order of the second turning shaft 22, the separation nip 38, and the first turning shaft 21, the document S can be appropriately conveyed. The separation nip 38 mentioned herein is a contact portion between the separation member 35 and the pickup roller 31.

That is, when the first turning shaft 21 is located upstream from the separation nip 38, in order to cause the pickup roller 31 to pass through the pickup roller hole 13 and enable switching between the document mounting state and the document feeding state, a case in which the first turning shaft 21 has to be disposed at a position protruding into the feeding path of a document S, is considered. In this case, since the document S comes in contact with the first turning shaft 21 protruding into the feeding path of a document S or the first member 11, the document S cannot be fed. When the second turning shaft 22 is located downstream from the separation nip 38, the same result as when the document mounting board 10 is constituted by only one member, is obtained, and thus advantages that the document mounting board 10 is changed to the storage state or the document S can be easily brought into contact with the separation member 35 in the document mounting state, cannot be achieved.

On the contrary, since the first turning shaft 21, the second turning shaft 22, and the separation nip 38 are arranged in the order of the second turning shaft 22, the separation nip 38, and the first turning shaft 21 from upstream to downstream in the feeding direction of a document S, the document S can be satisfactorily fed and advantages based on the change of the angle between the first member 11 and the second member 12 of the document mounting board 10, can be achieved.

Figure 10:
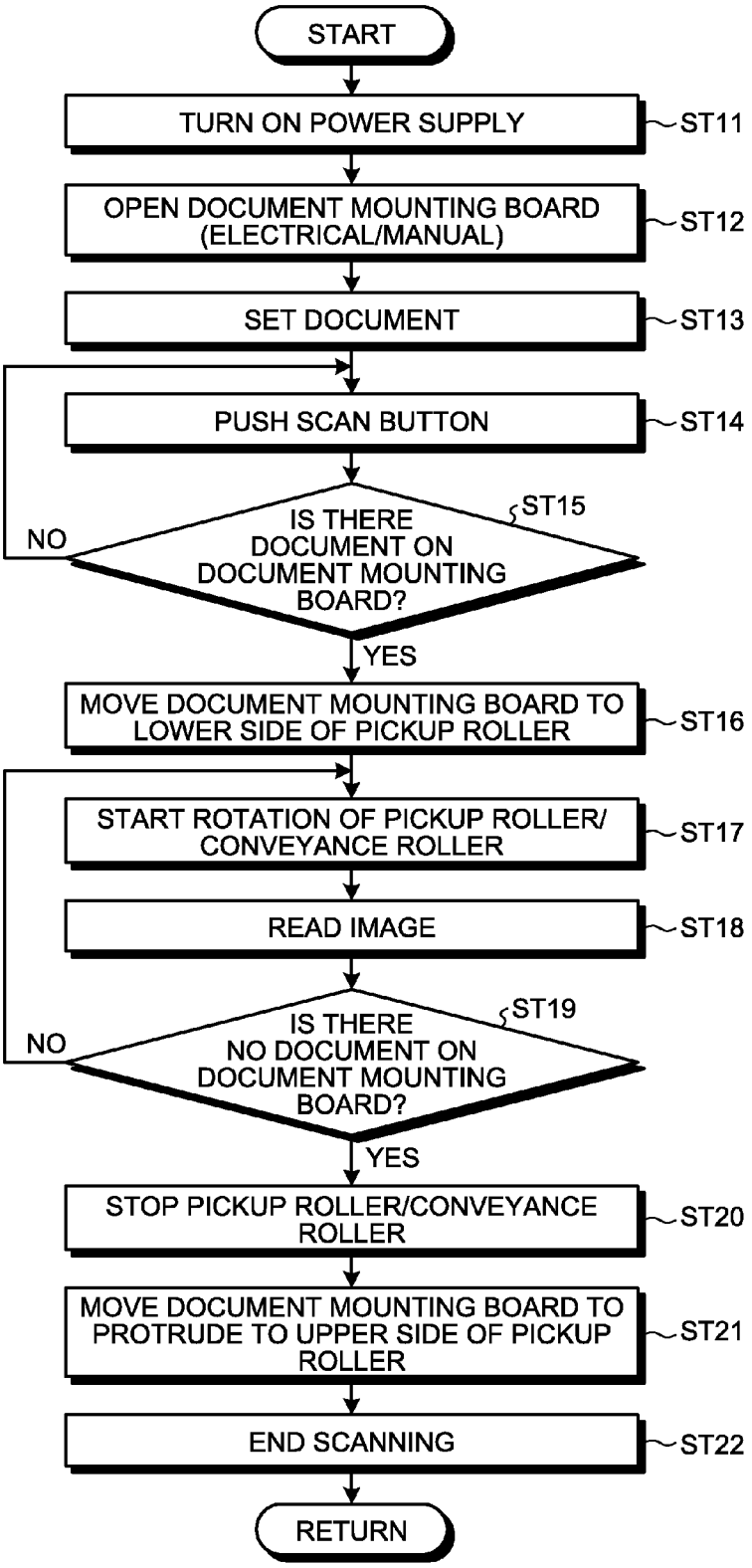
FIG. 10 is a flow diagram illustrating a processing sequence when an image of a document is read by the scanner including the sheet feeding device according to the embodiment.

A processing sequence when an image of a document S is read by using the scanner 1 performing the above-mentioned operations, will be described below. FIG. 10 is a flow diagram illustrating a processing sequence when an image of a document is read by using the scanner including the sheet feeding device according to the embodiment. When an image of a document S is read by using the scanner 1 including the sheet feeding device 5 according to the embodiment, the power supply is turned on by operating the power supply button 61 (step ST11). Then, the document mounting board 10 is opened (step ST12). That is, the document mounting board 10 in the storage state is changed to the document mounting state. The operation of opening the document mounting board 10 in the storage state and changing to the document mounting state may be performed manually by allowing a user to grasp the document mounting board 10, or the storage state may be changed to the document mounting state electrically using a driving force generated by the mounting board driving motor 25.

Then, a user sets documents S to be read by mounting the documents S of which images will be read on the mounting surface 15 of the document mounting board 10 (step ST13). When the documents S are mounted on the document mounting board 10, the scan button 62 is pushed (step ST14). Accordingly, an input instruction indicating start of scanning is input to the scanner 1.

When the scan button 62 is pushed, it is first determined whether or not a document S is present on the document mounting board 10 (step ST15). This determination is performed on the basis of the detection result of the document sensor 65 by the control unit 70. When it is determined that no document S is present on the document mounting board 10 (No determination in step ST15), pushing of the scan button 62 is waited for again in step ST14.

On the other hand, when it is determined that a document S is present on the document mounting board 10 (Yes determination in step ST15), the document mounting board 10 is moved downward to the lower side of the pickup roller 31 (step ST16). That is, the mounting board driving motor 25 is driven to switch the document mounting board 10 in the document mounting state to the document feeding state. At this time, the angle θ formed by the first mounting surface 16 and the second mounting surface 17 also increases.

By activating the feed driving motor 45 or the conveyance driving motor 46 in this state, the pickup roller 31 or the conveyance roller 41 starts its rotation (step ST17). Accordingly, the documents S mounted on the document mounting board 10 are fed from the document mounting board 10 to the image reading unit 50 one by one. The image reading unit 50 reads an image of a document S that is forwarded in this way (step ST18). The image read by the image reading unit 50 is transmitted to the control unit 70 and is stored in a storage unit (not illustrated) or the like of the scanner 1.

Then, it is determined whether a document S is not present on the document mounting board 10 (step ST19). This determination is also performed on the basis of the detection result of the document sensor 65 by the control unit 70. When the control unit 70 determines that a document S is present on the document mounting board 10 (No determination in step ST19), the document S mounted on the document mounting board 10 continues to be fed again in step ST17.

On the other hand, when it is determined that no document S is present on the document mounting board 10 (Yes determination in step ST19), the pickup roller 31 and the conveyance roller 41 are stopped (step ST20). That is, since there is no document S to be fed to the image reading unit 50 by the pickup roller 31 or the conveyance roller 41, the pickup roller 31 and the conveyance roller 41 are stopped by stopping the feed driving motor 45 and the conveyance driving motor 46.

Then, the document mounting board 10 is made to protrude upward from the pickup roller 31 (step ST21). That is, the mounting board driving motor 25 is driven to switch the document mounting board 10 in the document feeding state to the document mounting state. When the document mounting board 10 is switched to the document mounting state, the scanning by using the scanner 1 ends (step ST22). The scanner 1 ending the scanning waits for mounting documents S on the document mounting board 10 by switching the document mounting board 10 to the document mounting state and prepares for next scanning.

In the sheet feeding device 5 according to the above-mentioned embodiment, when documents S are mounted on the document mounting board 10, the mounting surface 15 is located above the pickup roller 31 and thus the documents S on the mounting surface 15 can be more satisfactorily moved to the position of the separation member 35 and be brought into contact with the separation member 35. When the documents S mounted on the document mounting board 10 are fed, the document S moving to the position of the separation member 35 can be fed by the pickup roller 31 by causing the document mounting board 10 to turn such that the mounting surface 15 moves downward from the contact portion 32 of the pickup roller 31 with the document S. As a result, it is possible to more satisfactorily prevent occurrence of non-feeding of a document S.

The document mounting board 10 includes the first member 11 and the second member 12, the first mounting surface 16 is located above the pickup roller 31 when documents S are mounted on the document mounting board 10, and the first mounting surface 16 moves downward from the pickup roller 31 when a document S is fed. Accordingly, the document S can be fed by the pickup roller 31. In this way, by constituting the document mounting board 10 with the first member 11 and the second member 12, the document mounting board 10 can be changed to be suitable for each use state of the scanner 1. As a result, it is possible to more satisfactorily prevent occurrence of non-feeding of an document S and to achieve improvement in usability.

In the document mounting board 10, when documents S are mounted on the document mounting board 10, the angle formed by the first mounting surface 16 and the second mounting surface 17 is smaller than that when the document S is fed. Accordingly, the document S mounted on the document mounting board 10 can be easily moved to the position of the separation member 35. As a result, it is possible to more satisfactorily prevent non-feeding of a document S from occurring.

When an image of an document S is not read, the document mounting board 10 is stored in a state in which the second member 12 is located above the image reading unit 50 and it is thus possible to achieve compactness of the scanner 1 in a non-used state. As a result, it is possible to improve usability of the scanner 1.

Since the first mounting surface 16 has the friction reducing processed portion for reducing frictional resistance to the document S moving in the feeding direction, the document S on the mounting surface 15 can be more satisfactorily moved to the position of the separation member 35 when documents S are mounted on the document mounting board 10. As a result, it is possible to more satisfactorily prevent occurrence of non-feeding of an document S.

Modified Example

Figure 11:
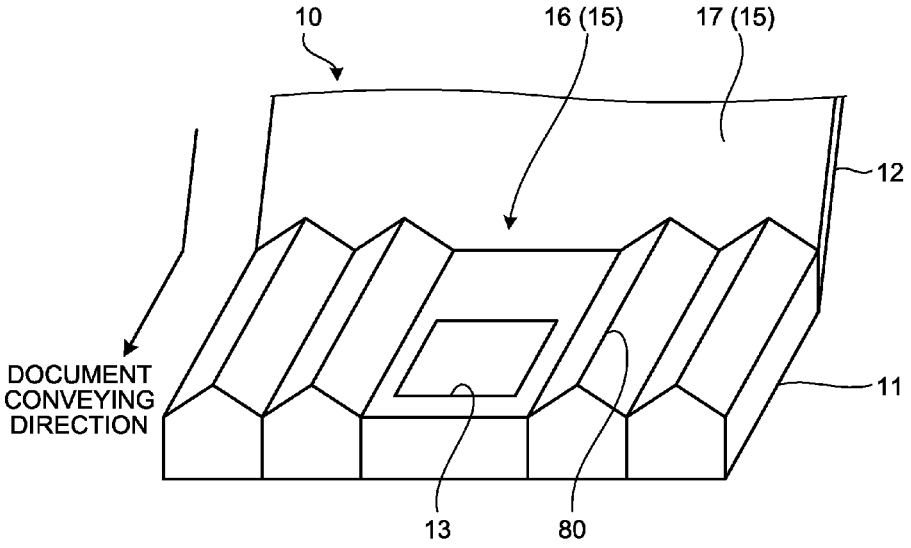
FIG. 11 is a diagram illustrating a case in which protrusions are formed by a friction reducing process in a sheet feeding device according to a modified example of the embodiment.

In the sheet feeding device 5 according to the embodiment, surface treatment using a material having a low frictional coefficient is used as the friction reducing process which is performed on the first mounting surface 16, but the friction reducing process is not limited thereto. FIG. 11 is a diagram illustrating a modified example of the sheet feeding device according to the embodiment in which protrusions are formed by the friction reducing process. In the friction reducing process which is performed on the first mounting surface 16, for example, as illustrated in FIG. 11, a plurality of protrusions 80 may be formed on the first mounting surface 16. The protrusions 80 are formed on the first mounting surface 16 to have a constant height in the conveyance direction of a document S and form unevenness in the direction perpendicular to the conveyance direction of a document S. That is, the protrusions 80 are formed to protrude from the first mounting surface 16 when viewed from the conveyance direction of a document S. By forming the plurality of protrusions 80 on the first mounting surface 16 in this way, a contact area between the first mounting surface 16 and the document S can be decreased. Accordingly, it is possible to reduce a frictional force therebetween and to more satisfactorily move a document S to the position of the separation member 35, when documents S are mounted on the document mounting board 10.

Since the first member 11 moves downward from the top end of the pickup roller 31 at the time of feeding a document S, the protrusions 80 are not easily abraded by the fed document S. Accordingly, even when friction reduction is carried out using the protrusions 80, it is possible to continuously decrease a frictional force between the first mounting surface 16 and a document S.

Figure 12:
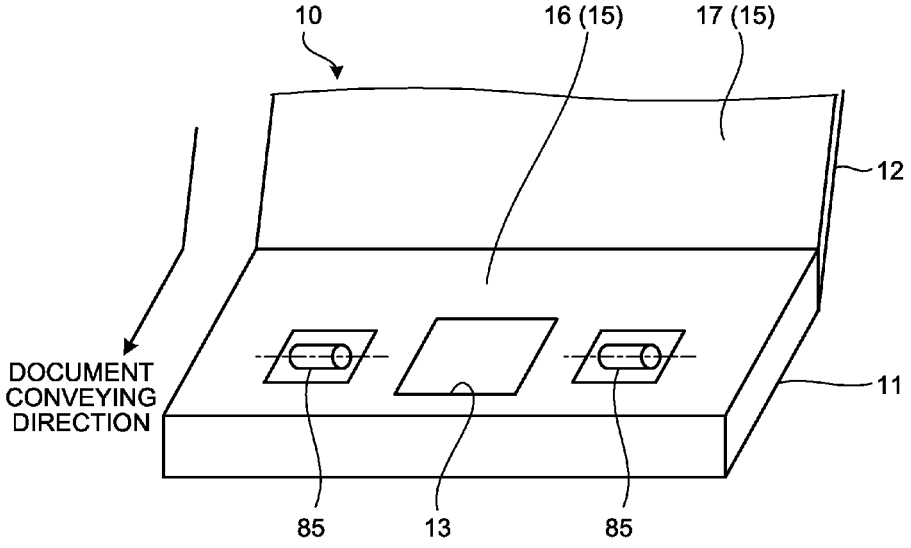
FIG. 12 is a diagram illustrating a case in which rollers are used by a friction reducing process in a sheet feeding device according to a modified example of the embodiment.

FIG. 12 is a diagram illustrating a modified example of the sheet feeding device according to the embodiment in which a roller is used by the friction reducing process. In the friction reducing process which is performed on the first mounting surface 16, for example, as illustrated in FIG. 12, a plurality of rollers 85 may be disposed in the first mounting surface 16. Each roller 85 is formed in a substantially columnar shape and is disposed to be rotatable about a rotation shaft parallel to the rotation shaft 33 of the pickup roller 31. The roller 85 is buried in the first member 11 to have a positional relationship that the top end thereof slightly protrudes from the first mounting surface 16. By disposing the plurality of rollers 85 in the first mounting surface 16 in this way, resistance acting when a document S moves on the first mounting surface 16, can be reduced and thus the document S can be more satisfactorily moved to the position of the separation member 35 at the time of mounting documents S on the document mounting board 10.

Figure 13:
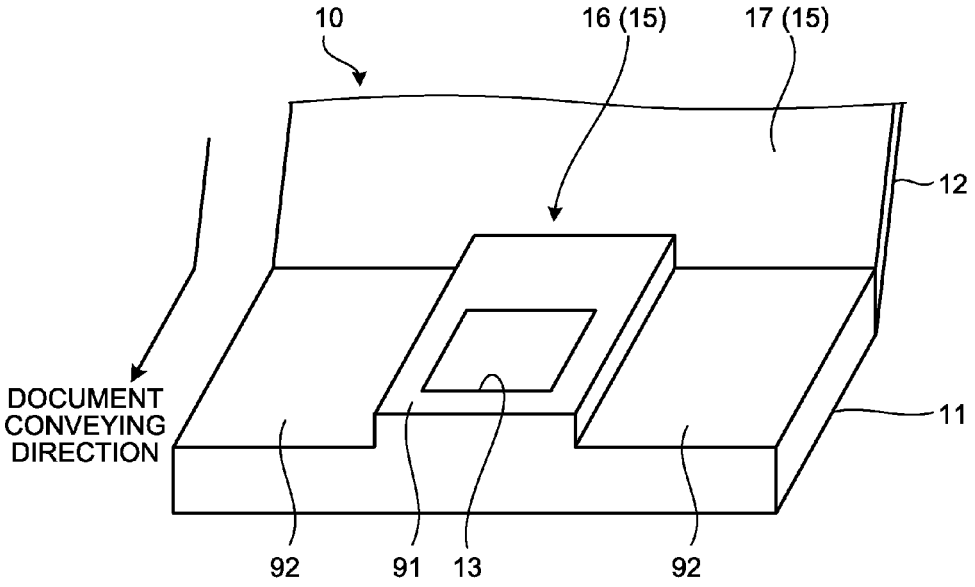
FIG. 13 is a diagram illustrating a case in which a stepped portion is formed by a friction reducing process in a sheet feeding device according to a modified example of the embodiment.

FIG. 13 is a diagram illustrating a modified example of the sheet feeding device according to the embodiment in which a stepped portion is formed by the friction reducing process. In the friction reducing process which is performed on the first mounting surface 16, for example, as illustrated in FIG. 13, a stepped portion may be formed in the periphery of the pickup roller hole 13 and the other portion. That is, the periphery of the pickup roller hole 13 may be formed as a convex portion 91 protruding from the other portion and a portion separated from the pickup roller hole 13 may be formed as a concave portion 92 having a smaller height than the convex portion 91. By forming the stepped portion including the convex portion 91 and the concave portion 92 in the first mounting surface 16, a contact area between the first mounting surface 16 and a document S can be decreased. Accordingly, it is possible to reduce a frictional force therebetween and to more satisfactorily move a document S to the position of the separation member 35 at the time of mounting documents S on the document mounting board 10.

Figure 14:
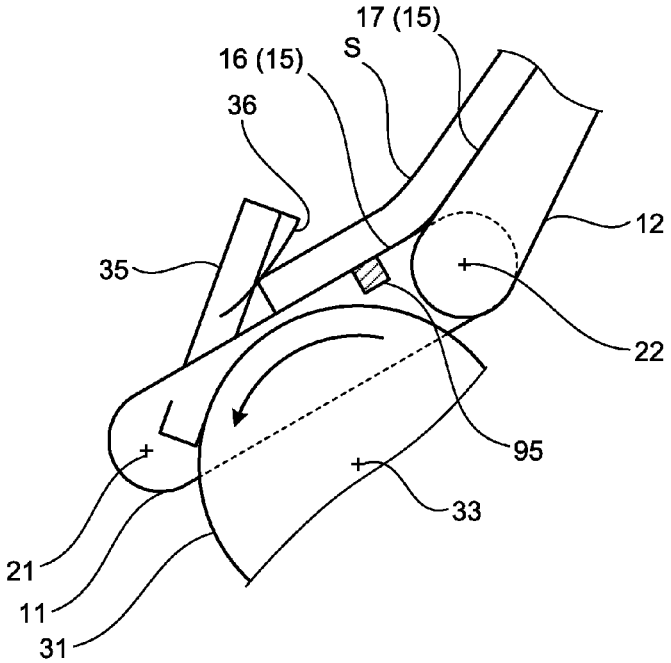
FIG. 14 is a diagram illustrating a case in which a vibration generating member is disposed by a friction reducing process in a sheet feeding device according to a modified example of the embodiment.

FIG. 14 is a diagram illustrating a modified example of the sheet feeding device according to the embodiment in which a vibration generating member is disposed by the friction reducing process. In the friction reducing process which is performed on the first mounting surface 16, for example, as illustrated in FIG. 14, a vibration generating member 95 may be disposed in the first member 11. The vibration generating member 95 can electrically generate vibration in the first mounting surface 16. In this way, by disposing the vibration generating member 95 in the first member 11 and generating vibration in the first mounting surface 16 by using the vibration generating member 95, a contact time between the first mounting surface 16 and a document S is decreased and it is thus possible to reduce a frictional force therebetween. Accordingly, it is possible to more satisfactorily move a document S to the position of the separation member 35 at the time of mounting documents S on the document mounting board 10.

It is preferable that the vibration generating member 95 be activated to generate vibration in the first mounting surface 16 after the document sensor 65 detects that a document S is mounted on the document mounting board 10 and before the document S is fed by the feed mechanism 30.

The sheet feeding device according to the present disclosure can more satisfactorily prevent non-feeding of an document from occurring.

All examples and conditional language recited herein are intended for pedagogical purposes of aiding the reader in understanding the disclosure and the concepts contributed by the inventor to further the art, and are not to be construed as limitations to such specifically recited examples and conditions, nor does the organization of such examples in the specification relate to a showing of the superiority and inferiority of the disclosure. Although the embodiments of the present disclosure have been described in detail, it should be understood that the various changes, substitutions, and alterations could be made hereto without departing from the spirit and scope of the disclosure.

What is claimed is:

1. A sheet feeding device comprising:

a document mounting board configured to have documents mounted thereon;

a feed mechanism configured to include a pickup roller rotating to forward the documents and to feed the documents mounted on the document mounting board to a downstream side in a feeding direction of the documents; and a base portion configured to support the feed mechanism, wherein a downstream end of the document mounting board in the feeding direction of the document in the feed mechanism, is connected to the base portion, so as to be rotatable about a first turning shaft that is parallel to a rotation shaft of the pickup roller, the first turning shaft is located downstream from the feed mechanism in the feeding direction of the document in the feed mechanism, a mounting surface of the document mounting board on which the documents are mounted, is located above the pickup roller, when the documents are mounted on the document mounting board, the document mounting board turns about the first turning shaft such that the mounting surface moves downward and the mounting surface moves downward from a contact portion of the pickup roller with the document, when the documents mounted on the document mounting board are fed, the document mounting board includes:

a first member that is connected to the base portion so as to be rotatable about the first turning shaft; and a second member that is connected to an end of the first member, which is opposite to the end connected to the base portion, the second member is connected to the first member, so as to be rotatable about a second turning shaft that is disposed parallel to the first turning shaft, a first mounting surface, which is the mounting surface of the first member on which the documents are mounted, is located above the pickup roller, when the documents are mounted on the document mounting board, and the first mounting surface moves downward from the contact portion of the pickup roller with the document, when the documents mounted on the document mounting board are fed.

2. The sheet feeding device according to claim 1, wherein an angle formed by a second mounting surface, which is the mounting surface of the second member on which the documents are mounted, and the first mounting surface in the document mounting board, when the documents are mounted on the document mounting board, is smaller than that when the documents are fed.

3. The sheet feeding device according to claim 1, wherein an image reading unit configured to read an image of the document fed by the feed mechanism, is disposed downstream from the feed mechanism in the feeding direction of the document in the feed mechanism, and when the image reading unit does not read an image of the document, the document mounting board is stored in a state, in which the second member is located above the image reading unit, by causing the first member to turn about the first turning shaft toward the image reading unit and by causing the second member to turn about the second turning shaft toward the image reading unit.

4. The sheet feeding device according to claim 1, wherein the first mounting surface has a friction reducing processed portion for reducing frictional resistance against the document moving in the feeding direction.

* * * * *